United States Patent [19]

Yoshiya

[11] Patent Number: 4,913,028

[45] Date of Patent: Apr. 3, 1990

[54] BRAIDING MACHINE WITH SYNCHRO BELT SYSTEM

[75] Inventor: Hayasaka Yoshiya, Hamamatsu, Japan

[73] Assignee: Kokubu Inc., Hamamatsu, Japan

[21] Appl. No.: 272,382

[22] Filed: Nov. 17, 1988

[30] Foreign Application Priority Data

Jul. 23, 1988 [JP] Japan ..... 63-98169[U]

[51] Int. Cl.[4] ..... D04C 3/06; D04C 3/20

[52] U.S. Cl. ..... 87/44; 87/33; 87/50

[58] Field of Search ..... 87/33, 37, 38, 44, 45, 87/50, 51

[56] References Cited

U.S. PATENT DOCUMENTS 746,215 12/1903 Whitehead ..... 87/50

FOREIGN PATENT DOCUMENTS 303019 3/1930 United Kingdom ..... 87/45

*Primary Examiner*—John Petrakes

*Attorney, Agent, or Firm*—Fleit, Jacobson, Cohn, Price, Holman & Stern

[57] ABSTRACT

A braiding machine is to form a braid by rotating a plurality of horn dogs, respectively in synchronism and alternately each in reverse directions and running a plurality of carriers for yarn supply along carrier ways while transferring said carrier successively to neighboring horn dogs, and is provided with a belt drive system comprising plurality of synchro pulleys rotating each integrally with a plurality of said horn dogs, and a synchro belt for rotating each synchro pulley in synchronism and alternately each in reverse directions by being passed over between a plurality of said horn dogs.

3 Claims, 4 Drawing Sheets

BRAIDING MACHINE WITH SYNCHRO BELT SYSTEM

BACKGROUND OF THE INVENTION

The present invention relates to a braiding machine with synchro belt system for forming round braids, flat braids and others by braiding a plurality of yarn strings.

Common round braids and flat braids for various industrial or ornamental uses are produced by a plurality of yarn strings which are braided so that each string or each two yarn strings may be alternately top or bottom therein. For this reason, any braiding machine for forming these type of braids is requested to run a plurality of carriers for yarn supply along two carrier ways intersecting each other in successive characters 8 shapes, like clockwork with a prescribed interval in reverse directions.

Thus so far, this type of braiding machines have been adapted to rotate a plurality of horn dogs respectively in synchronism and alternately each in reverse directions, and run each carrier along carrier ways while transferring each carrier by each horn dog successively to neighbouring horn dogs.

Besides, in order to rotate a plurality of horn dogs respectively in synchronism and alternately each in reverse directions, a positive rotational drive system is needed. However when a plurality of adjacently engaged gears, a plurality of sprocket wheels and chains passes thereupon are used as a rotational drive system for this purpose, a problem arises that very large noise is produced by these gears or chains in rotational drive.

Furthermore any structure using gears or chains cannot neglect oiling of lubricant to reduce wears therein. For this reason, a problem has so far arisen that oil drips have been scattered in surroundings during rotational drive to be attached on expensive yarns wound on bobbins of carriers, and have produced oil stains on completed braid products. To prevent yarn contamination, installation of bobbin covers on bobbins on carriers may be considered, and, in that case however, it is necessary to provide a longitudinal slit on bobbin covers for smoothly drawing out yarns, and a problem to make structures and operabilities complicate would occur.

Additionally in structures using gears or chains, the higher the speed of rotational drive becomes, the more intense generation of noises and scattering of oil drips may result. For this reason, the rotational speed of horn dogs is limited approximately to 200 revolutions per minute, and there exist a problem that a high speed operation of such machines is not practical.

Besides, conventional braiding machines are adapted to run a plurality of carriers along carrier ways. For this reason, there exist problems, similar to the above-mentioned rotational drive systems, of generation of large noises, scattering of drips of oil applied for wear prevention, limits in running speed and others between the sliding surface of carriers and matting slide surface of carrier ways and others.

SUMMARY OF THE INVENTION

In order to resolve the above-mentioned problems, an object of the present invention is to provide braiding machines generating only small noises, and requiring no oiling of lubricants and capable of performing high speed operations.

To accomplish the above-mentioned object, the present invention provides in the above-mentioned braiding machine a belt drive system comprising a plurality of synchro pulleys rotating respectively integral with a plurality of said horn dogs, and synchro belts for rotating a plurality of synchro pulleys respectively in synchronism and alternately each in reverse directions by being passed over between a plurality of said synchro pulleys.

Further in the above-mentioned braiding machines are provided a plate surface at least on one of the sliding surface of a plurality of said carriers and the mating slide surface of said carrier ways.

In the above-mentioned braiding machine may be furthermore provided a belt drive system comprising a plurality of synchro pulleys rotating respectively integral with a plurality of said horn dogs, and synchro belts for rotating synchro pulleys respectively in synchronism and alternately each in reverse directions being passes over between a plurality of these synchro pulleys, and plate surface at least one of the sliding surface of a plurality of said carriers and the mating slide surface of said carrier ways.

A braiding machine in accordance with the present invention produces almost no noises, and requires no oiling of lubricant, because in the machine each synchro pulley is rotated respectively in synchronism and alternately each in reverse direction by a synchro belt driven into travel. Furthermore the absence of noise generation and scattering of oil drips enables the high speed operation of the machine.

And a plate surface provided on at least one of the sliding surface of each carrier and the mating slide surface of carrier ways gives a good slide when each carrier makes slidingly travels on carrier ways. For this reason, almost no noise is generated in running carriers, and no oiling of lubricant is required. Because of the absence of problems of noise generation and scattering of oil drips, a high speed running of carriers is enabled.

Furthermore the use of both a belt drive system and plate surface enables a high speed operation of the machine with perfect low noise and no oiling of lubricant.

BRIEF DESCRIPTION OF THE DRAWINGS

The accompanying drawings are to illustrate an embodiment in accordance with the present invention, and, FIG. 1 is a longitudinal sectional view of major parts of a braiding machine of said embodiment.

DETAILED DESCRIPTION OF THE PREFERRED EMBODIMENT

In the below, will be described an embodiment of a braiding machine in accordance with the present invention. The braiding machine in this embodiment is to braid 16 strings of yarn for two each of them to be placed alternately on top and bottom.

Figure 1:
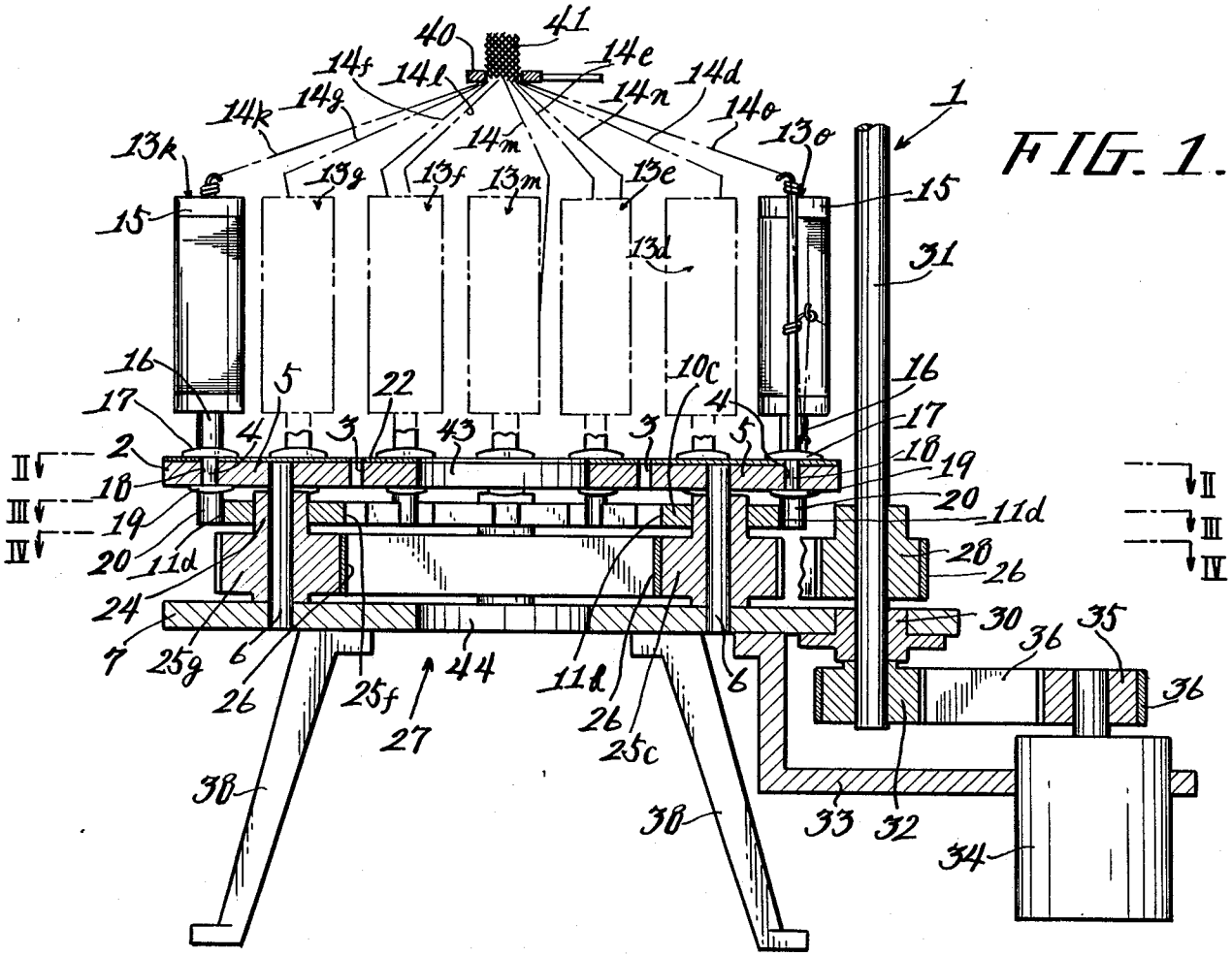
Figure 2:
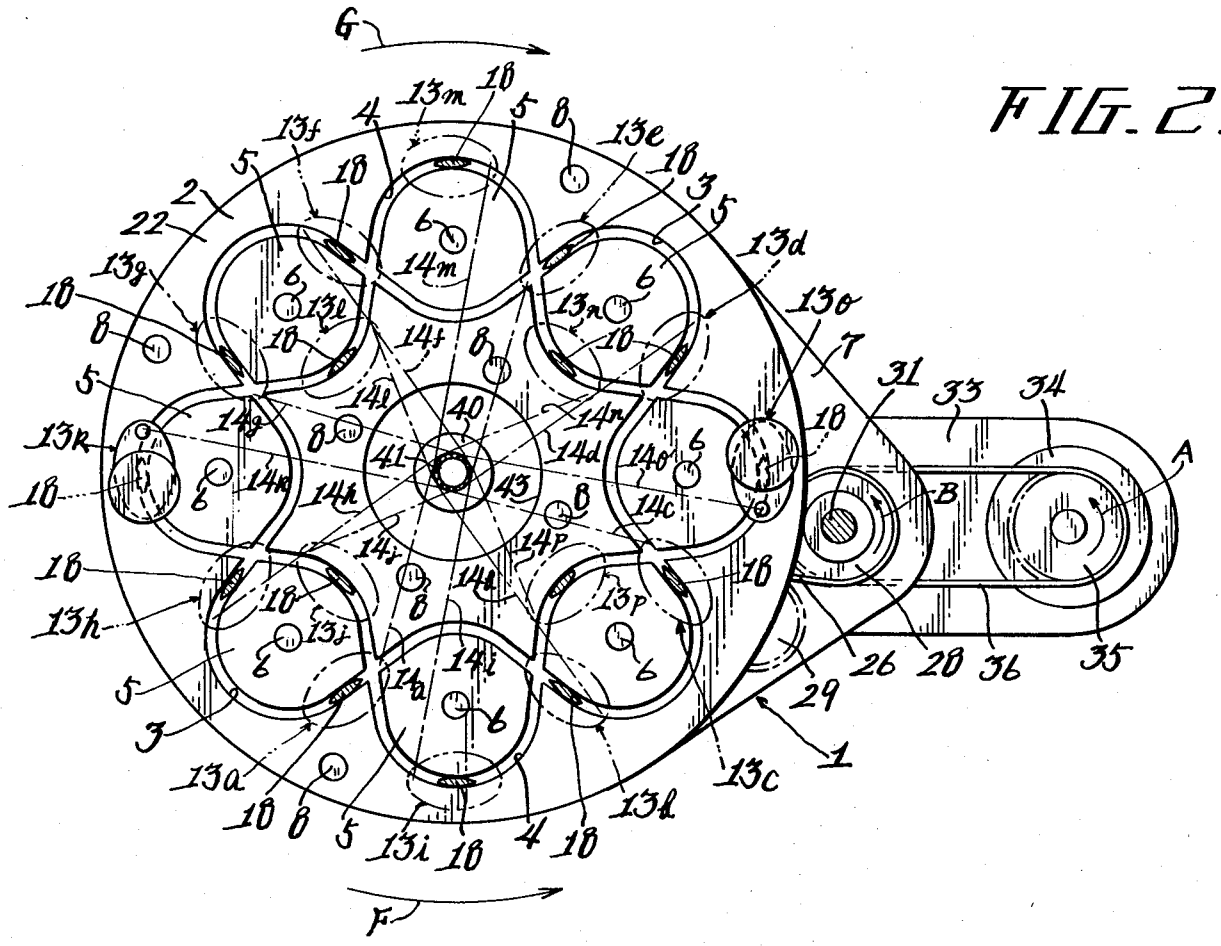
FIG. 2 is a plan view seen from a line II—II in FIG. 1.

Firstly, as shown in FIG. 1 and FIG. 2, the braiding machine 1 is provided with two carrier ways 3, 4 along a circular direction on a horizontal plate-like top-plate 2 of the machine 1. These two carrier ways 3, 4 are formed by grooves penetrating through the plate 2 and intersect each other at eight places to form successive characters 8 shapes. Eight pieces of quoits 5 having circular shapes surrounded by both carrier ways 3, 4 are separate bodies from the top plate 2, and each of these quoits 5 are fixed to a horizontal flat bottom plate 7 respectively with vertical studs 6 so as to be flush with the top plate 2. Additionally the top plate 2 and bottom plate 7 are fixed to each other by other vertical studs 8.

Figure 3:
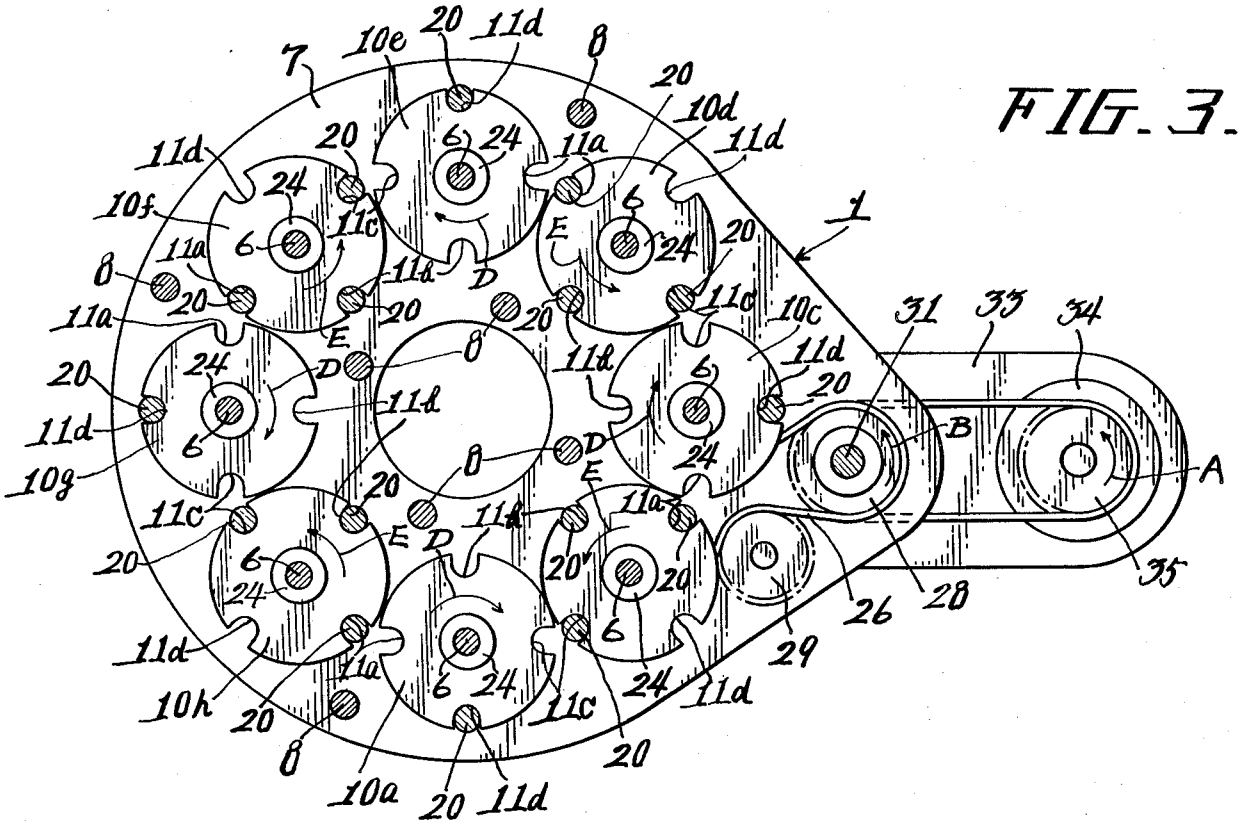
FIG. 3 is a plan view seen from a line III—III in FIG. 1.

Secondly as shown in FIG. 1 and FIG. 3, horn or drive dogs 10*a* to 10*h* are respectively inserted rotatably onto each of said studs 6 beneath the top plate 2, and each of said horn dogs 10*a* to 10*h* is disposed in a horizontal plane, and are neighbouring to each other. Each horn dog 10*a* to 10*h* is formed of wear-resistant synthetic resins such as MC Nylon (trade name) into a disc shape, and is provided with four peripheral drive recesses or horns 11*a* to 11*d* comprising half-oblong shaped relief each spaced apart 90° in the periphery thereof.

And as shown in FIG. 1 and FIG. 2, 16 pieces of carrier 13*a* to 13*p* in total or 8 pieces along each of said carrier ways 3, 4 are arranged so as to slidingly travel along the carrier ways. As shown in FIG. 5, a carrier 13 comprises a bobbin 15 wound with a yarn string 14 and a body 16 for rotatably supporting the bobbin 15. And underneath the body 16, are integrally formed an upper brim 17, a web 18, and a lower brim 19, and, underneath the lower brim 19, is also integrally formed a lug 20. And as shown in FIG. 1 and FIG. 2, the web is inserted into each of the carrier ways 3, 4, and the underside of the upper brim 17 is applied to contact with the top plate 2 and the top surface of the quoit 5. Also as shown in FIG. 3, the lug 20 is engaged with each of the horn 11*a* to 11*d* of the horn dogs 10*a* to 10*h*.

On the other hand, as shown in FIG. 1, a plate surface 22 is provided all over on the top surface of the quoit 5 and top plate 2 or the mating sliding surfaces of each of the carrier ways 3, 4. For this plate surface is used fluoric resin, for example, RURON (trade name) composed of tetra-fluoride-ethylene, which excels in wear resistance and chemical resistances, and has a low-friction property without oiling of lubricant. The plate surface 22 is provided by enameling, after a liquid material is sprayed and dried on the top surface of the top plate 2 and quoit 5.

Figure 4:
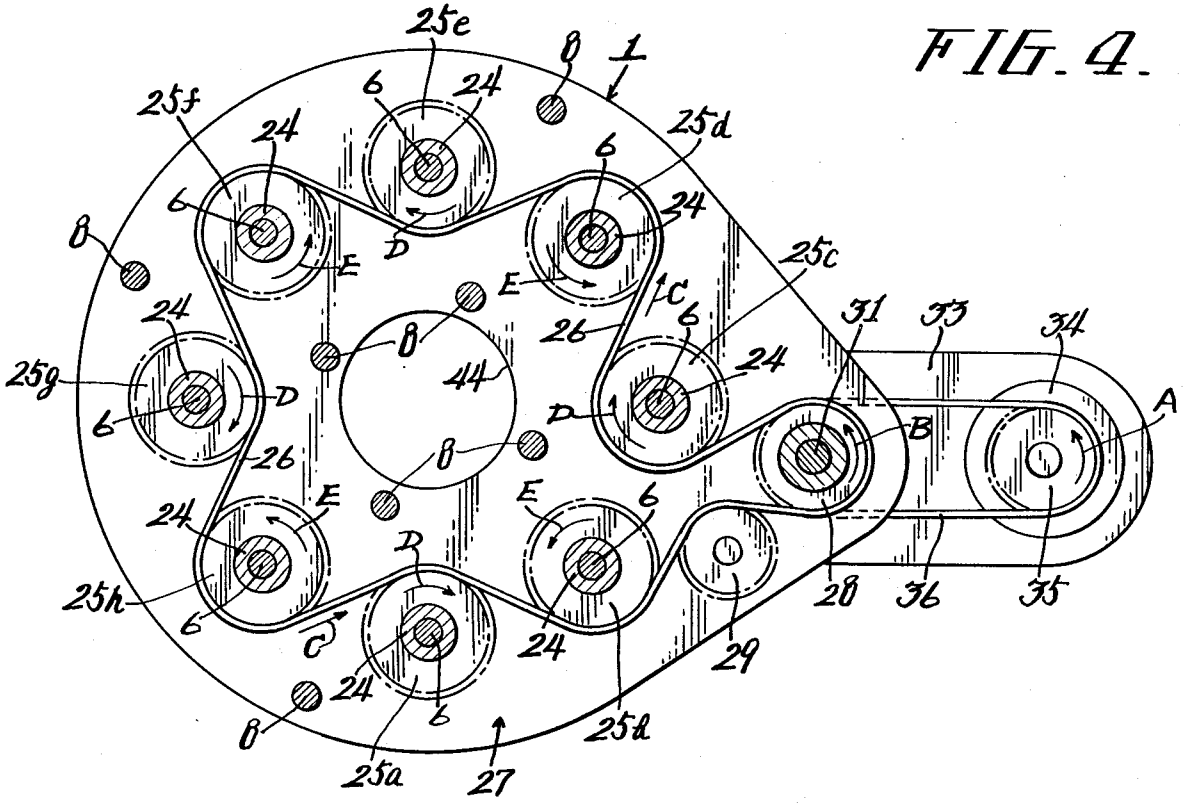
FIG. 4 is a plan view seen from a line IV—IV in FIG. 1.

Nextly as shown in FIG. 1 and FIG. 4, synchro pulleys (timing pulleys) 25*a* to 25*h* having teeth on its periphery are inserted rotatably onto each of said stud 6 over the top plate 7, and each of these synchro pulleys 25*a* to 25*h* is arranged in a horizontal plane without contacting with each other. And further each of horn dogs 10*a* to 10*h* is fixed securely to the periphery of the top boss portion 24 of each synchro pulley 25*a* to 25*h* respectively to rotate both as an integral body.

And an endless ring-like synchro belt (timing belt) 26 is passed over between each of synchro pulleys 25*a* to 25*h*. This synchro belt 25 has its teeth on both side or front and back side thereof, and is passed over stagger or so as to engage with synchro pulleys 25*a*, 25*c*, 25*e*, 25*g* on the front side, and with synchro pulleys 25*b*, 25*d*, 25*f*, 25*h* on the back side. And a belt drive system 27 comprises said synchro pulley 25*a* to 25*h* and synchro belt 26. In addition, the synchro belt 26 is passed over between each synchro pulleys 25*a* to 25*h* for each of horn dogs 10*a* to 10*h* to take the positions in FIG. 3 in their rotation.

And, the synchro belt 26 is drawn out between synchro pulleys 25*b* and 25*c* to be passed around a drive synchro pulley 28. And a synchro pulley 29 to adjust the belt tension is provided between synchro pulley 25*b* and drive synchro pulley 28, and the pulley 29 is arranged adjustably in its position relative to the bottom plate 7. Said drive synchro pulley 28 is fixed securely to a rotating shaft 31 supported vertically to the bottom plate 7 via a bearing 30, and, underneath the bottom plate 7, a driven synchro pulley 32 is fixed securely to the lower end of the rotating shaft 31. And a motor 34 is mounted to the bottom plate 7 via a mounting portion 33, and a synchro belt 36 is passed over between the drive synchro pulley 35 secured to the motor shaft of the motor 34 and the driven synchro pulley 32. In addition, a leg 38 is mounted to the bottom plate 7.

In the next, will be explained the function in forming a braid in the above-mentioned braiding machine 1.

Firstly, in FIG. 1 and FIG. 4, when the drive synchro pulley 35 of the motor 31 is driven, for example, in the arrow A direction, then the rotating shaft 31 is driven to rotate in the arrow B direction via the synchro belt 31 and driven synchro pulley 32, and also drive synchro pulley 28 is driven to rotate in the same direction. The synchro belt 26 is driven to run in the arrow C direction, and thereby each of synchro pulleys 25*a* to 25*h* is driven to rotate in synchronism and alternately each in the reverse direction. (arrow D and arrow E direction) Each of horn dogs 10*a* to 10*h* is driven integrally with each of synchro pulleys 25*d* to 25*h*, and therefore, as shown FIG. 3, each of horn dog 10a to 10h is also driven in synchronism and alternately each in reveres direction.

Further in FIG. 2 and FIG. 3, when horn dogs 10*a*, 10*h* make half a rotation in the arrow D, E directions, the lug 20 of the carrier 13 is engaged with the horn 11*a* of the horn dog 10*a* by the guide action of the guided portion 18 and carrier way 3, to be transferred in the arrow D direction by the horn dog 10*a*. Then the lug is engaged with the horn 11*a* of the horn dog 10 which has made half a rotation in synchronism. In the meantime, the lug 20 of the carrier 13*b* travels half a rotation in the arrow E direction by the horn dog 10*b*. At the same time, other carriers 13*e* to 13*h* also slidingly travel in the same manner, and therefore each of carriers 13*a* to 13*h* travel in the arrow F direction as a group along the carrier way 3 with a predetermined interval. And by the same action, each of carriers 13*i* to 13*p* also slidingly travel in the arrow G direction as a group along the carrier way 4 with a predetermined interval.

By the way, because said belt drive system 27 comprising each of synchro pulleys 25*a* to 25*h* and synchro belt 21 is used, to rotate each of horn dogs 10*a* to 10*h* respectively in synchronism and alternately each in reverse direction, nearly no noises are produced in rotative drives. Furthermore, an extremely precise synchro timing is also achieved by the use a single synchro belt alone.

The belt drive system 27 requires no oiling of lubricant, and therefore any problem such as scattering of oil drip in surroundings never occurs.

Furthermore, the operational speed of the machine can be raised to, for example, 450 revolutions per minute for a revolutional speed of horn dogs 10*a* to 10*h*.

In addition, because plate surfaces are provided on the mating slide surface of the carrier ways 3 and 4, each of carriers 13*a* to 13*p* makes an extremely smooth sliding travel. Accordingly, almost no noises are produced, no oiling of lubricant is required, and a high speed running is enabled. Because plate surfaces are provided all over on the top surface of the top plate 2 and quoit 5, the plate surfaces can be formed simply in a single process.

Nextly in FIG. 2, when the carrier 13*a* has travelled to the position of the carrier 13*b*, in this period, the carrier 13*i* is transferred to the position of the carrier 13*j*, the carrier 13*p* to the position of the position 13*i*. As a consequence while the carrier 13*a* is travelling along the inner portion of the carrier way 3, the two carriers 13*i*, and 13*p* also travel along the outer portion of the carrier way 4; and therefore, a yarn string 14*a* of the carrier 13*a* comes to the underside of yarn strings 14*i* and 14*p* of the carriers 13*i* and 13*p*. On the other hand, when the carrier 13*b* has travelled to the position of the carrier 13*c*, in this period, the carrier 13*p* is transferred to the position of the carrier 13*i*, and the carrier 13*o* to the position of the carrier 13*p*. Consequently, while the carrier 13*b* is travelling along the outer portion of the carrier way 3, the two carriers 13*p* and 13*o* are travelling along the inner portion of the carrier way 4; and therefore a yarn string 14*b* of the carrier 13*b* comes to the top side of the yarn strings 14*p* and 14*o* of the carriers 13*p* and 13*o*.

Resultingly, the yarn strings bailed out by the travel of each of carriers 13*a* to 13*p* produce a braid 41 by being braided alternately each two yarn strings on the top or underside of the braid in a yarn gathering section 40 provided on the top center of the braiding machine. FIG. 6 shows the texture of this braid 41. The braid 41 thus formed is wound up with the winding-up unit (not shown) driven by the rotation of the rotating shaft 31. And circular 43 and 44 provided at the center of the top plate 2 and bottom plate 7 constitute a guiding hole when a core is to be incorporated into the center of the braid 41.

In the above the present invention has been described with reference to its one embodiment; and however enables various useful modifications thereupon based on the technical concept thereof without being limited to this embodiment.

For example, the horn dogs in the embodiment are fixed securely to the synchro pulleys respectively; and however they may formed in one body respectively.

In this embodiment, a plate surface is provided on the top surface of the top plate and quoit; and however the plate surface may be provided on the bottom surface of the upper brim or the sliding surface of the carrier, or on both surface in the above. The plate surface may be provided on the inner surface of the groove for forming the carrier ways or on the outer surface of the web of the carrier.

The present invention achieves the effects stated in the below, as it is structured as described in the above.

By the use of a belt drive system comprising synchro pulleys and synchro belt as a rotative drive mechanism for rotating a plurality of horn dogs, the noise produced in rotative running can be outstandingly reduced, and by the absence of necessities for oiling of lubricants, yarn contaminations due to scattering of oil drips can be excluded. The non-existence of problems on noise generation and scattering of oil drips enables an outstanding improvement in the operational speed of the machine, and enhance remarkably the manufacture efficiencies for braids.

And also installation of plate surfaces at least on one of the sliding surface of carriers and mating slide surface of carriers ways enables extremely smooth sliding travel of carriers and dissolves problems on noise generations, scattering of oil drips in travelling and limitations on travel speeds and others.

Furthermore the installation of a belt drive system comprising synchro pulleys and synchro belt as well as the application of a plate surface on at least one of the sliding surface of carriers and mating slide surface of carrier ways provides a braiding machine with extremely low noise, perfectly no need for lubricant oiling, and capabilities for high speed operations, in cooperation of the two effect described in the above.

What is claimed is:

1. A braiding machine comprising a plate formed with two endless carrier ways configured to provide a ring of substantially circular loops, each loop being interconnected to an adjacent loop in a Figure-8 configuration, bobbin carriers mounted in the carrier ways, and a drive system for moving the bobbin carriers around the ring successively from loop to loop with selected carriers being moved in opposite directions around the ring, the drive system comprising a rotary drive dog for each loop, the drive dog being mounted for rotation substantially coaxially with respect to the loop in a plane adjacent a plane containing said plate, the drive dogs having respective peripheral drive recesses and the carriers having respective projecting lugs for receipt in said recesses and transfer between the recesses of successive drive dogs, a drive pulley mounted for rotation with each drive dog and an endless drive belt wound around the pulleys for rotating the pulleys and drive dogs by movement of the belt, the belt being wound in opposing drive direction about adjacent pulleys for driving the adjacent drive dogs in opposite directions respectively, the drive system further including drive means for moving the belt.

2. A machine as claimed in claim 1 wherein the drive means includes a belt and pulley-type drive.

3. A machine as claimed in claim 1 wherein the plate has a low friction covering on a surface thereof adapted to support carriers.

* * * * *